United States Patent [19]

Hadam

[11] 3,998,251

[45] Dec. 21, 1976

[54] CLAMPING DEVICE AT GRIPPER HEADS FOR SHUTTLELESS LOOMS

[75] Inventor: Wilhelm Hadam, Reutlingen, Germany

[73] Assignee: Lindauer Dornier Gesellschaft mbH., Germany

[22] Filed: Jan. 20, 1976

[21] Appl. No.: 650,802

[30] Foreign Application Priority Data

Apr. 17, 1975 Germany ..... 2517011

[52] U.S. Cl. ..... 139/448

[51] Int. Cl.[2] ..... D03D 47/20

[58] Field of Search ..... 139/429, 430, 450, 447, 139/448, 263, 196.2; 242/149

[56] References Cited

UNITED STATES PATENTS

| | | | |
|---|---|---|---|
| 3,112,774 | 12/1963 | Bostic | 139/263 |
| 3,163,184 | 12/1964 | Cherpin | 139/196.2 |
| 3,851,676 | 12/1974 | Kokkinis | 139/448 |
| 3,901,284 | 8/1975 | Riolet | 139/448 |

*Primary Examiner*—Henry S. Jaudon
*Attorney, Agent, or Firm*—James E. Bryan

[57] ABSTRACT

This invention relates to an improvement in a clamping device adapted for use at a gripper head for a shuttleless loom, in which a gripper head pulls a weft thread out of the shed while held between two clamping jaws by a clamping lever of a clamping device subject to spring action while a control means acts upon said clamping lever provided with a clamping jaw, the improvement which comprises means whereby one of said clamping jaws is movable at a part carrying it and is springingly, yieldingly positioned, in the opening direction of the clamping device, in a limited manner, and said control means operates in a two-stage manner such that the first actuating stage is within the limits of movability of said movable clamping jaw, and the second actuating stage lifts the clamping jaws off of each other.

9 Claims, 4 Drawing Figures

FIG. 1
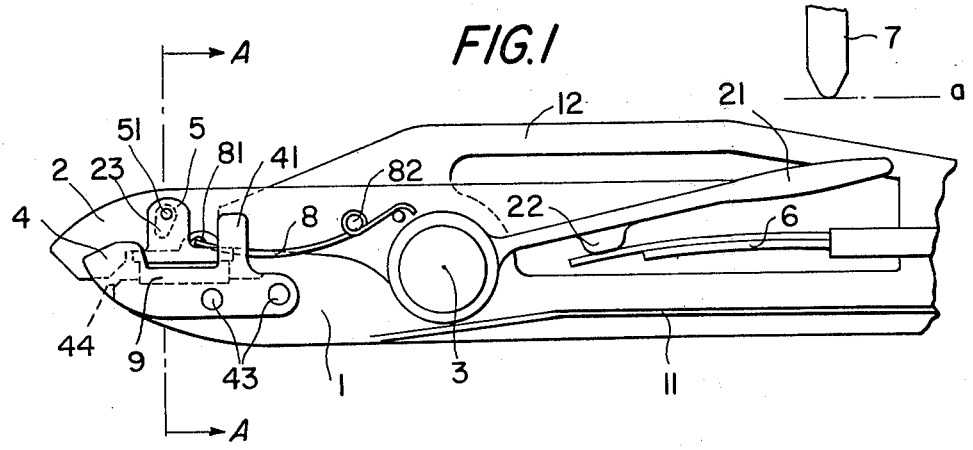
FIG. 3
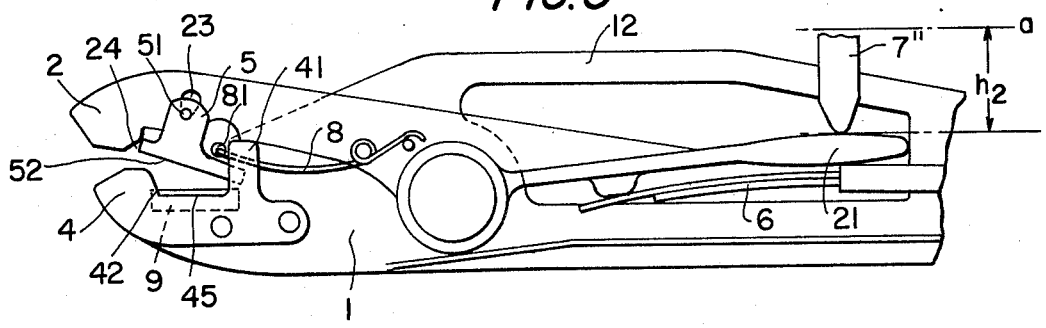
FIG. 2
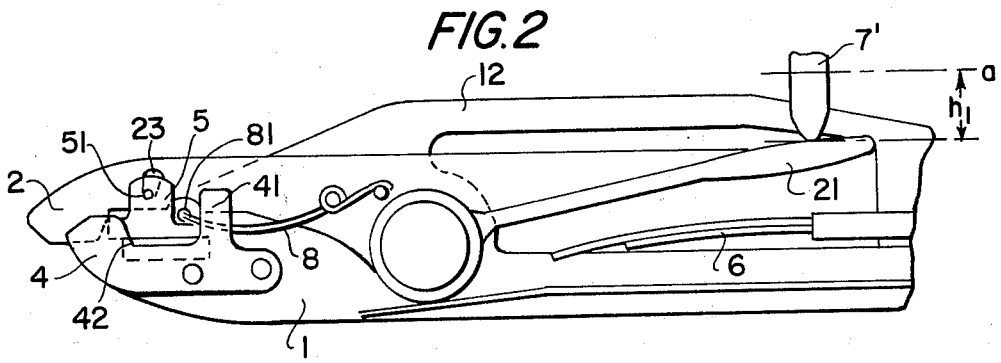
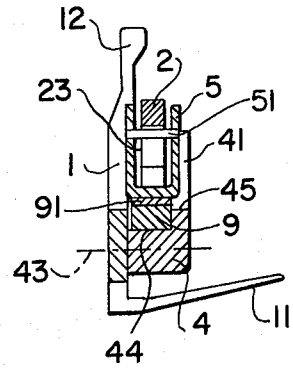
FIG. 4

CLAMPING DEVICE AT GRIPPER HEADS FOR SHUTTLELESS LOOMS

The present invention relates to a clamping device at gripper heads for shuttleless looms in which the weft thread is inserted by means of grippers fed or advanced into the shed and retracted again therefrom in a reciprocating manner. The grippers are seated generally as gripper heads at the tips of long rods or of flexible bands adapted to be advanced. It is customary that the weft thread drawn off of a supply spool which is positioned outside of the shed is siezed or grasped, by means of a clamping device, by a gripper head coordinated to this side of the loom and, during the advance of the gripper rod, brought approximately to the center of the shed and transferred to a counter-gripper advanced from the other side of the loom. The receiving-counter-gripper is also provided with a clamping device and, during the return movement thereof, pulls the weft thread completely into the shed. As soon as the receiving gripper head has left the shed, the clamping device of the gripper head is opened by means of a control mechanism, the weft thread is released, and then cast on by the reed. The thread insertion operation proceeds in a similar manner also in looms having only one gripper rod in which a single gripper rod reaches from the side of the loom positioned opposite the supply spool through the entire shed and inserts the thread into the shed in a single operation.

In the aforementioned looms, the free weft thread end pulled through the shed projects at the selvage. Specific difficulties in this type of weft thread insertion are that the projecting thread end is relatively long. At the beginning of the weft thread insertion operation it is not possible to have the weft thread - being supplied outside of the shed to the gripper head - seized or gripped very closely at its free end by the clamping device of the gripper head. A certain thread end always projects beyond the clamping device of the gripper head. In the weft thread delivery or transfer in the center of the shed, the receiving gripper head engages in the transmitting gripper head, provided in a fork-like manner, and siezes or grips the weft thread between the two fork ends. As a result, another small piece of weft thread length is added during the thread delivery, which piece will project over the completely inserted weft thread at the outer edge of the fabric and subsequently must be cut off as waste. In the conventional fabric widths, this waste may amount to 3 to 8% or more of the fabric width.

Several proposals already have been made for the purpose of reducing the weft thread waste. According to one of these proposals, both fork ends of the transmitting gripper head are provided with clamping devices for the weft thread. These two clamping devices are so coupled with each other that, during the thread delivery or transfer and during the joint actuation of the clamping devices by means of a control lever with a time lag, the clamping device of one fork arm holding the free weft thread end is opened initially, and the other clamping device is opened thereafter. The two clamping devices may have therein a varying clamping force. In this manner at the beginning of the return movement of the receiving gripper the free weft thread end is initially pulled through a part of the way by means of the hook-shaped tip or end of the receiver and only thereafter finally gripped by the clamping device of the receiver. During this time, the weft thread end is held by the second clamping device of the transmitter. Thus it is possible, during the thread delivery or transfer in the center of the shed, to successfully shorten a small piece of the projecting weft thread end, and thus to somewhat reduce the waste as a whole. This type of shortening of the weft thread end projection has the disadvantage, however, that the loose thread end cannot be controlled, and the thread transfer in the center of the shed is thereby rendered uncertain.

Above all, however, also the formation of the selvage on the side of the loom positioned opposite the supply spool remains unsatisfactory. Since the weft thread is under tension during the inserting operation, it attempts — when being freed by the clamping device — to spring back, whereupon it then will come to be limply positioned within the shed. Under certain circumstances the thread even springs back to such a degree that it forms loops and remains completely within the shed. Produced thereby is a selvage flaw. In order to eliminate these disadvantages, a specific catching selvage or strip is customarily provided, whose warp threads form a separate shed which is closed earlier than the remaining shed. Accordingly, the catching selvage or strip firmly holds the inserted weft thread until the final casting on thereof by the reed. The catching selvage is later separated from the fabric. While it is true that an attractive selvage with relatively short projecting thread ends is thereby obtained, the warp threads of the catching selvage or strip and the weft thread ends bound therein increase the thread waste very considerably.

In connection with shuttleless looms with weft thread insertion by means of gripper heads advanced into and retracted again from the shed and with clamping devices for the weft thread controlled from without, it is therefore the object of the present invention to still further reduce the thread waste.

This object is obtained, in accordance with the present invention, by virtue of the fact that one of the two clamping jaws of the clamping devices of the gripper head is movable and, in the opening direction of the clamping device, is springingly, yieldingly positioned in a defined limited manner, and in that the control mechanism for the actuation of the clamping device is provided in a two-stage fashion in such a manner that the first actuating stage is positioned within the limits of movability of the movable clamping jaw. The second actuating stage lifts the clamping jaws off of each other. The control mechanism is so provided therein that the first actuating stage for the clamping device becomes operative shortly prior to the emergence of the gripper head from the shed. The second actuating stage for the clamping device becomes operative only later, for example in the end position of the gripper head outside of the shed. The additional elastic force acting exclusively upon the movable clamping jaw is proportioned for a braking effect to be exerted upon the weft thread passing through. The clamping lever is advantageously composed of two co-acting, singly spring-suspended parts which act with a different force, each part or element of which is adapted to execute a limited proper motion, whereby a graduated clamping is rendered possible.

Mounted at the forward or front part of one of the clamping jaws, according to another embodiment of the present invention, is a hook-like projection which is operative during the first actuating stage and guides the weft thread. In this manner, the free weft thread end is held in a stretched fashion to its end under the braking effect of the movable clamping jaw and pulled out of the shed in a stretched position. The hook-like projection guides the weft thread and prevents it from sliding out of the clamping jaw. Accordingly, until its casting, the weft thread end is continuously held under tension and can remain in the clamping device until that time without any need to provide for special means next to the gripper head. Any springing back of the thread is flawlessly prevented and the weft thread waste is reduced to an inevitable piece of about 1.5 centimeters long which corresponds to the distance from the selvage to the clamping device. Moreover, the entire catching selvage may be omitted.

The present invention is not limited to gripper looms with thread transfer in the center of the shed, but is suitable also for looms in which only a single gripper — instead of a pair of grippers — is provided on the side of the loom facing away from the supply spool, and is extended through the entire shed.

One embodiment of the present invention will now be further described hereinafter with reference to the accompanying drawings, wherein FIG. 1 illustrates a gripper head with a closed clamping device;

FIG. 2 illustrates a gripper head with a semi-opened clamping device in the first actuating stage;

FIG. 3 illustrates a gripper head with a fully opened clamping device in the second actuating stage, and FIG. 4 is a cross-sectional view through the gripper head taken along line A—A of FIG. 1.

The gripper head comprises a stationary part 1 at which are mounted a guide portion 11 at the bottom and a web portion 12 at the top. These elements serve for guiding the gripper head through the shed. They are intended primarily to assure the protection of the warp threads. The rod, or the elastic band, for advancing or retracting the gripper head is not illustrated herein. Rotatably mounted at the stationary part 1 of the gripper head is a movable two-armed clamping lever 2. The center of rotation of this mounting support is designated with reference numeral 3. The front or forward arm of the clamping lever 2 carries a movable clamping jaw 5. The rear arm of the clamping lever 2 has an actuating or running-up surface 21 for the control mechanism 7. The control mechanism is shown herein as a movable lever 7, but other embodiments are equally possible, for example running-up ramps, or the like. The second arm of the clamping lever 2 has a lug portion 22 against which a return spring 6 comes to rest. This return spring 6 retains the clamping lever 2 in its closed position and effects the clamping force for the inserted weft thread.

Secured to the stationary part 1 of the gripper head in the forward portion is a removable anvil 4 with a heel 44. The mounting or fastening is indicated by the screws 43. The anvil 4 has two projections 41 and 42 which delimit forwardly and rearwardly a flat intermediate section 45 of the anvil 4. In this section 45 the weft thread is received and guided. Advantageously provided on the heel 44 in the present example is an elastic base or foundation 9 having a wear-resistant surface or supporting layer 91 as one clamping jaw. If desired, it is possible also to eliminate the elastic base or foundation; but it is essential always that the clamping jaw have a smooth, wear-resistant surface in the area of the section 45, which surface projects slightly beyond the upper edge of the section 45.

The clamping lever 2 carries at its forward end a second movable clamping jaw 5 which, in the illustrated example, encloses the clamping lever 2 in a U-shaped fashion with two legs. Both legs are connected with each other by means of a pin 51, and this pin 51 is guided in an elongated hole 23 in the clamping lever 2. The elongated hole 23 extends approximately in the opening direction of the clamping device. By means of the elongated hole, the movable clamping jaw 5 is imparted a little movability in the opening direction of the clamping device. Furthermore, the clamping jaw is thereby rendered tiltable. An additional spring 8 is secured at the point 82 to the clamping lever 2. The point of application 81 thereof, for example a small roller which comes to rest against the movable clamping jaw 5, is positioned behind the pin 51. In this manner it is possible to bring about a tilting of the movable clamping jaw. The spring 8 is laterally guided by the projection 41 of the anvil 4.

In FIG. 1, the control mechanism 7 is shown in the inoperative position of rest thereof. The lower edge of the control mechanism 7 is therein positioned on line a shown in dash-dotted lines. Upon the lug portion 22 of the clamping level 2 acts the full pressure of the return spring 6, whereby the clamping lever is retained in its closed position. The strong pressure of the spring 6 holds the weft threads (not shown) firmly clamped-in between the two clamping jaws with their clamping surfaces 52 and 91. The force of the return spring 6 is supported herein by the considerably smaller force of the spring 8. The pin 51 of the movable clamping jaw 5 is positioned in the upper part of the elongated hole 23, whereby the clamping jaw 5 is firmly pressed against the clamping jaw 9 of the anvil 4.

In FIG. 2, the clamping device is shown in the first actuating stage. The control mechanism 7 has here assumed the position 7'. The movable clamping lever 2 here has been pushed down at the rear end thereof. This first actuating stage is shown at the control mechanism 7' by the stroke $h_1$ with respect to the base line *a*. The tip or end of the movable clamping lever 2 is slightly lifted. By means of the spring 8, however, the movable clamping jaw 5 is pressed further down. The pin 51 of the movable clamping jaw is here positioned in the lower portion of the elongated hole 23. Upon the clamping jaw 5 now merely acts the spring tension of the spring 8. This spring tension is sufficient to lightly hold the two clamping surfaces 52 and 91 upon each other. They exert therefore merely a braking effect upon the weft thread positioned therebetween. The weft thread thus may be pulled out of the clamping device. Thereby an uncontrollable complete sliding-out of the thread forwardly is prevented by the projection 42 at the anvil 4 which acts in a hook-like manner. The thread is there guided.

In the second actuating stage shown in FIG. 3, the control mechanism assumes the position 7''. The greater stroke is identified with $h_2$ with respect to the base line *a*. The tip or end of the movable clamping lever 2 is lifted still further. The lower end of the elongated hole 23 here carries along the pin 51 and therewith lifts the movable clamping jaw 5 off of the stationary clamping jaw 9, i.e. the contact surfaces 52 and 91 are separated from each other. Since the spring 8 acts with its point of application 81 upon the movable clamping jaw 5 behind the pin 51, the clamping jaw 5 is tilted. Thereby it opens forwardly. As a result, the thread may easily slide out or be easily inserted. A stop 24 at the front part of the clamping lever 2 delimits the tilting movement of the clamping jaw 5. In the last portion of the stroke $h_2$, the rear end of the clamping jaw 5 may become freed from the other clamping jaw 9. In this position, the weft thread may be received by the receiving gripper, for example in the center of the shed. The weft thread to be received may enter into the clamping device unhindered. The reception of the weft thread may take place in this manner not only in the center of the shed, but the thread reception also may take place equally as well on the side of the supply spool outside of the shed.

The operation of the present invention is such that the clamping device of the gripper head is fully opened for the thread reception according to FIG. 3. Since, in view of the circumstances set forth above, the weft thread cannot be seized or gripped at the most extreme end thereof, a long weft thread end projects relatively far beyond the clamping device. Thereupon, the clamping device is fully closed, as has been shown in FIG. 1, and in this position the gripper head is retracted through the shed. Shortly prior to the emergence of the gripper from the shed, the clamping device is slightly opened by the control mechanism in the first actuating stage, according to FIG. 2.

During the further retraction of the gripper, the weft thread end is now pulled — under tension and under the braking effect of the two clamping jaws only lightly resting against each other — out of the gripper to such an extent that it is completely stretched and is still just seized or gripped by the clamping device at the outermost end. The thread end projecting beyond the selvage has here only a length of approximately 1.5 centimeters, which represents a considerable shortening as compared to what has been heretofore achievable. In view of the fact that the weft thread end at the outermost end thereof is still retained just under tension, it cannot spring back. Only for casting the weft thread is the end thereof fully pulled out of the clamping device. At that time the advancing reed can pull the weft thread end out of the still braking clamping jaws. If desired, however, the clamping device also may be fully opened for this purpose in the second actuating stage. Also possible is the use of a specific edge thread clamp, in which case this clamp may be provided, for example, in known manner at the reed. During the casting operation, it holds the thread firmly as soon as the thread has been freed from the clamping device of the gripper. In any case, a separate catching selvage or strip is eliminated and the projecting thread end, and therewith the weft thread waste, are reduced to a minimum.

A particular advantage of the present invention is that, independently of the variations in thickness of the weft thread, the same braking force is effected at all times, and the arrangement of the present invention is suitable for all thread thicknesses. In view of the fact that the same clamping jaws execute two functions, namely in that they effect the clamping on the one hand, and are used for braking on the other hand, no special equipment is required in addition to the additional light spring.

The present invention lends itself to numerous modifications. For example, the movable or tiltable clamping jaw also may be accommodated at the stationary part of the clamping device, rather than at the movable clamping lever.

It will be obvious to those skilled in the art that many modifications may be made within the scope of the present invention without departing from the spirit thereof, and the invention includes all such modifications.

What is claimed is:

1. In a clamping device adapted for use at a gripper head for a shuttless loom, in which a gripper head pulls a weft thread out of the shed while held between two clamping jaws by a clamping lever of a clamping device subject to spring action while a control means acts upon said clamping lever provided with a clamping jaw, the improvement which comprises means whereby one of said clamping jaws is movable at a part carrying it and is springingly, yieldingly positioned in the opening direction of the clamping device, in a limited manner, and said control means operates in a two-stage manner such that the first actuating stage is within the limits of movability of said movable clamping jaw, and the second actuating stage lifts the clamping jaws off of each other.

2. A clamping device according to claim 1 in which said clamping lever comprises two co-acting individually spring-suspended means adapted to operate at a different spring force, each of said means being adapted to perform a limited motion, whereby a graduated clamping effect is rendered possible.

3. A clamping device according to claim 1 in which said spring action acting upon said movable clamping jaw is proportioned for a braking effect to be exerted upon a weft thread passing through said jaws.

4. A clamping device according to claim 1 including means whereby said movable clamping jaw is tiltably positioned in an elongated hole in said clamping lever.

5. A clamping device according to claim 1 including stop means delimiting movement of said movable clamping jaw.

6. A clamping device according to claim 1 including spring means having a point of application on said movable clamping jaw and positioned behind a tilting axis of said jaw.

7. A clamping device according to claim 1 including means whereby said movable clamping jaw encloses said clamping lever in a U-shaped manner.

8. A clamping device according to claim 1 including hook-like projection means on the front of one of said clamping jaws and adapted to be operative during said first actuating stage and to guide the weft thread.

9. A clamping device according to claim 1 including wear-resistant material on the surfaces of said clamping jaws adapted to contact said weft thread.

* * * * *